US006589111B1

(12) United States Patent
Giroux

(10) Patent No.: US 6,589,111 B1
(45) Date of Patent: Jul. 8, 2003

(54) SNOW EXTRACTOR FOR USE WITH AN AIR HANDLING SYSTEM

(75) Inventor: Arthur J. Giroux, Toms River, NJ (US)

(73) Assignee: **Conderv*A*Therm**, Union, NJ (US)

( * ) Notice: Subject to any disclaimer, the term of this patent is extended or adjusted under 35 U.S.C. 154(b) by 0 days.

(21) Appl. No.: 10/128,618

(22) Filed: Apr. 23, 2002

(51) Int. Cl.[7] ..... F24F 7/06

(52) U.S. Cl. ..... 454/254; 219/201; 454/338; 454/370

(58) Field of Search ..... 454/254, 256, 454/261, 276, 338, 370; 219/201

(56) References Cited

U.S. PATENT DOCUMENTS 5,791,984 A * 8/1998 Kane ..... 454/276

FOREIGN PATENT DOCUMENTS

JP 61234394 * 10/1986
JP 403011257 * 1/1991

* cited by examiner

*Primary Examiner*—Harold Joyce
(74) *Attorney, Agent, or Firm*—Straub & Pokotylo; John C. Pokotylo

(57) ABSTRACT

A snow removal device for use with an air handler or HVAC system includes an extractor plate and a heater for heating the extractor plate. The extractor plate has a plurality of holes and may be bent to define a series of connected "Vs". The heater may be a heater core, which may be coupled with a snow sensor. Air deflectors may be provided to deflect incoming air towards the hottest part(s) of the extractor plate. The holes in the extractor plate should be sized such that it does not act as a filter. If the heater is a heater core, it may be coupled with the extractor plate using bent metal retainers.

40 Claims, 5 Drawing Sheets

600

500'

700'

SNOW EXTRACTOR FOR USE WITH AN AIR HANDLING SYSTEM

§1. BACKGROUND

§1.1 Field of the Invention

The present invention concerns air handling and HVAC systems. More specifically, the present invention concerns eliminating snow from air entering an air handling or HVAC system.

§1.2 Related Art

The present invention may be used with factory built air handling systems or field built HVAC systems, or may be retrofitted (e.g., in the field) into existing HVAC systems. Air handling systems channel outside air into the ventilation system of buildings. Air handling systems are described further in §1.2.1. Then, the need for extracting snow from air entering air handling systems is introduced in §1.2.2. Finally, three known techniques for extracting snow from an air stream, as well as their perceived shortcomings, are described in §1.2.3.

§1.2.1 Air Handling Systems

Air handling systems supply fresh outside air to buildings. Air handling systems are often located on the roof of the building. The air is transferred throughout the building via a ventilation system, and may be processed along the way (e.g., heated, cooled, humidified, dehumidified, filtered, etc.). An air handling system typically includes a supply fan, pre-filters, filters and air processing units (e.g., heating coils, cooling coils, steam humidifiers and intake dampers). The components of the air handling system are typically enclosed in one or more rectangular structures. These structures are typically fabricated from steel and/or aluminum.

The supply fan controls the flow of the air entering the air handling system, and particles and contaminants are filtered out of the air by the pre-filter and the filter. The incoming air may also be processed, for example, the air may be heated on a cold day, or cooled on warm day, before it is injected into the ventilation system of a building.

§1.2.2 The Need for Extracting Snow

Problems occur in climates where snow is mixed with the air stream entering an air handling or HVAC system. Air filters can clog with frozen snow slush or ice, under snowy conditions, and their ability to filter out particles and contaminants may be compromised. In addition, the clogged filters can disrupt normal airflow and can stress the supply fan(s). Indeed, snow blocked filters can block air flow to vital areas or rooms of a buildings interior. This can create sever hazards in some instances. Therefore there is a need to extract snow from the air stream entering an air handling or HVAC system. Such snow extraction should occur before the snow would otherwise contact air filters. §1.2.3 Known Techniques for Extracting Snow and their Perceived Shortcomings There are known techniques for extracting snow from air streams. Such techniques include deploying air unit heaters, preheating coils, or mesh pads or grids. Forced air unit heaters are discussed in §1.2.3.1, auxiliary pre-heating coils in §1.2.3.2, and metallic mesh pads or woven mesh grids in §1.2.3.3. Unfortunately, however, each of these known techniques is believed to have limitations and disadvantages.

§1.2.3.1 Forced Air Unit Heater

A forced air unit heater technique for extracting snow from air streams uses a heated water and/or glycol solution and/or low-pressure steam to heat a first (ingress) section of an air handling system. The first section of an air handling system may be the section immediately following the air intake dampers. As air mixed with snow enters the air handling system, it passes through the heated section and the snow is semi-effectively removed from the air. The drawbacks to this method include a high initial cost, high operating costs, and high maintenance costs.

§1.2.3.2 Auxiliary Pre-Heating Coils

Another technique for extracting snow from air streams includes providing auxiliary pre-heating coils that include numerous rows of hollow tubes with heat radiating fins attached to the tubes. Hot water and/or glycol is passed through the tubes and heats the fins. When snow mixed air passes through the pre-heating coils, the snow comes in contact with the fins and melts. The drawbacks of this method include a high initial cost, high operating costs, and high maintenance costs. In the summer the auxiliary pre-heating coils need to be protected by a pre-filter, or the pre-heating coils should be removed. This added requirement increases the maintenance costs.

§1.2.3.3 Metallic Pads or Woven Mesh Grids

A third technique for extracting snow from air streams includes metallic pads or woven mesh grids with electric radiant heaters and/or a series of electric elements to melt snow. The apparatus described by Kane in U.S. Pat. No. 5,791,984 uses this third technique. The drawbacks of this method include a high initial cost, high operating costs, and high maintenance costs. In addition, the mesh pad element used to capture snow also acts as a filter trapping particles, contaminates and water. This may potentially lead to health risks, for example, mold and/or fungus growing on a mesh pad and being injected into the ventilation system of a building. The filtering effect may also lead to clogging of the mesh pad with snow, ice, or slush, disrupting normal airflow and stressing the supply fan. This technique may also require swapping the apparatus with a pre-filter as the seasons change, increasing maintenance costs.

Another drawback of metallic pads or woven mesh grids is that some of them employ "modular" type panels. Each panel has an electrical connection to the next panel. These electrical connections offer points where corrosion may occur, and points where the electrical contact of the melting elements may break. Continued checkups on these connections are necessary and therefore increase maintenance costs.

§1.2.4 Unmet Needs

Accordingly, there is a need for a snow extracting technique that has a low initial cost and low operating and maintenance costs, and that minimizes or eliminates potential health risks associated with mold or bacteria growth in the snow extracting element. The snow extractor should be positioned before any air filters in an air handling system to prevent the air filter from becoming clogged. In addition, the heating element should minimize or avoid connection points where corrosion or breaks may occur. The snow extractor should be able to be used in factory built air handler systems, or field built HVAC systems. Further, the snow extractor should be able to be retrofitted into existing air handler and HVAC systems.

§2. SUMMARY OF THE INVENTION

The present invention provides an apparatus for extracting snow from the air entering an air handling or HVAC system. This apparatus basically includes a plate and means for heating the plate. The plate is bent along a plurality of vertical axes to define a series of connected "VI"s having an alternating series of edge points and pockets and has perforated holes. The pockets may be flattened to form a trough, though they needn't be.

The means for heating the plate may be a heater core including vertical runs provided adjacent to the (flattened) pockets on a second side of the plate. A control element for sensing snow mixed with air entering an air handling system may also be provided. Such a control element may be adapted to activate the heater core when snow is detected, and to deactivate said heater core when snow is no longer detected The apparatus may further include heater core retainers being placed over the vertical runs of the heating coil to hold the heater core to the plate, and/or deflectors being bent along a vertical axis located in the middle of the deflector. The deflectors may be situated on the points of the first side of the plate. The deflectors may deflect entering air towards a hottest part of the plate.

The plate and the means for heating the plate may be provided to produce a counter flow reaction in which extremes of warm and cold head towards each other.

§3. BRIEF DESCRIPTION OF THE DRAWINGS

§4. DETAILED DESCRIPTION OF THE INVENTION

The present invention involves novel methods and apparatus for extracting snow from an air stream. The following description is presented to enable one skilled in the art to make and use the invention, and is provided in the context of particular embodiments and methods. Various modifications to the disclosed embodiments and methods will be apparent to those skilled in the art, and the general principles set forth below may be applied to other embodiments, methods and applications. Thus, the present invention is not intended to be limited to the embodiments and methods shown and the inventor regards his invention as the following disclosed methods, apparatus and materials and any other patentable subject matter to the extent that they are patentable.

§4.1 Exemplary Environment in which a Snow Extractor may be used

Figure 1:
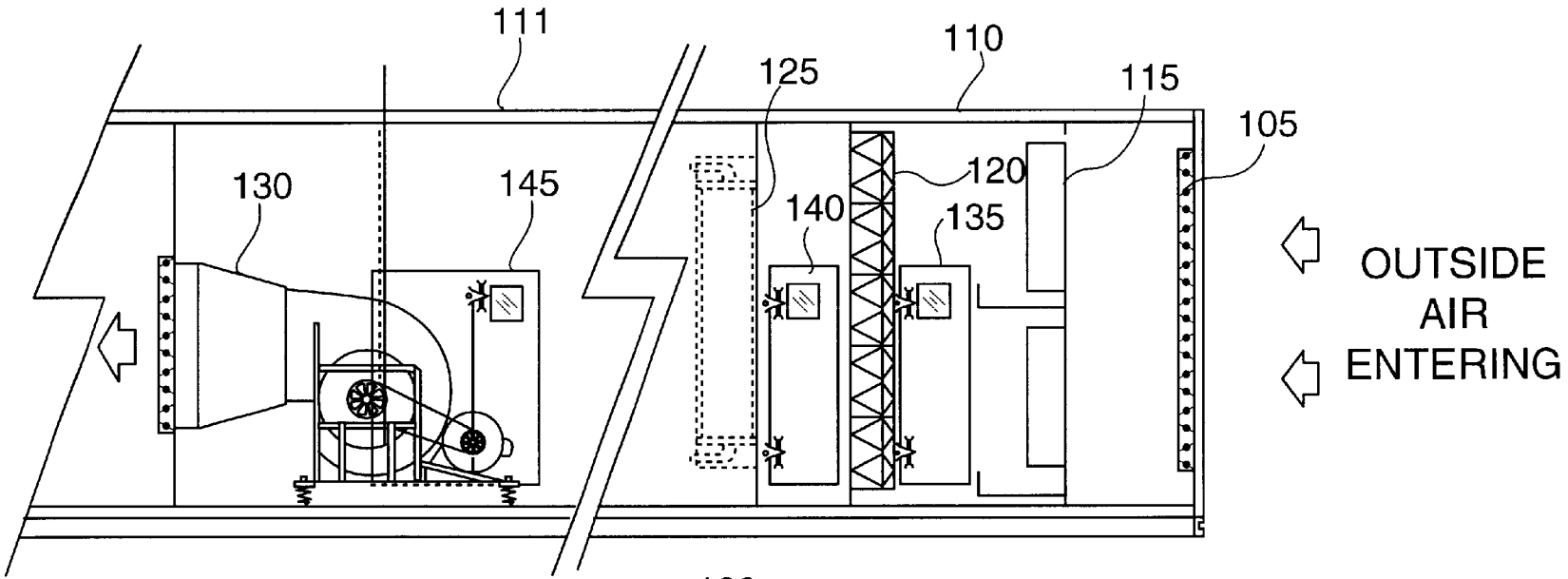
FIG. 1 is a diagram of an exemplary air handing system including a snow extractor made in accordance with the present invention.

As mentioned above, the present invention involves methods and apparatus for extracting snow from an air stream that is entering an air handling system. FIG. 1 illustrates an exemplary air handling system 100 provided with a snow extractor made in accordance with the present invention. The air handling system 100 includes first and second outer casing sections 110 and 111, respectively.

The first outer casing section 110 includes intake dampers 105, a snow extractor 115, a filter 120, a preheat coil 125, and access doors 135, 140. The second outer casing section 111 includes an access door 145 and a supply fan 130.

An exemplary operation of an air handling system works as follows. The supply fan 130 creates a negative pressure inside the casing sections 110 and 111 causing outside air to be drawn into the casing 110. Incoming outside air is dampened by air dampeners 105. An exemplary snow extractor 115 made in accordance with the present invention is positioned after the air dampeners 105 and before the filter 120. The snow extractor 115 melts snow mixed with the air. Holes in the extractor 115 allow particles and contaminates to pass through so that they do not gather on the extractor 115. Instead the particles are captured on the filter 120. Then, the air stream may be heated by the preheat coil 125. The supply fan 130 controls the flow of air entering the ventilation system of a building.

§4.2 Exemplary Elements and Configurations

Exemplary first and second embodiments of the present invention are described in §§4.2.1 and 4.2.2, respectively. Then, exemplary components for implementing a snow extractor made in accordance with the present invention are described in §4.2.3. Finally, exemplary operations of the first and second embodiments are described in §§4.2.4 and 4.2.5, respectively.

§4.2.1 First Exemplary Snow Extractor Embodiment

Figure 2:
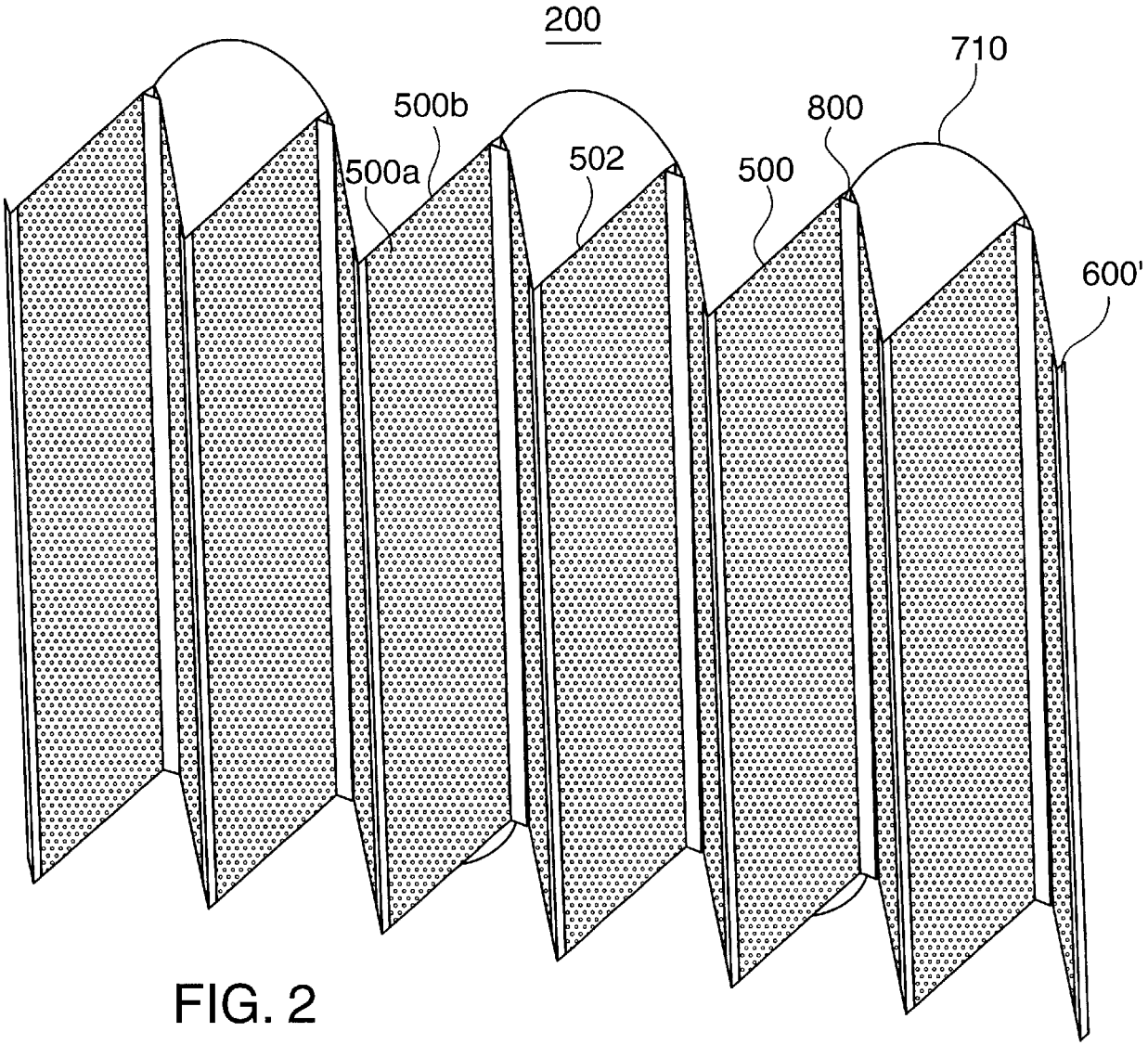
FIG. 2 is a diagram illustrating an isometric view of an exemplary first embodiment of a snow extractor made in accordance with the present invention.

FIG. 2 illustrates an isometric view of a first embodiment 200 of an exemplary snow extractor of the j present invention comprising: an extractor plate 500 having a first side 500*a*, a second side 500*b*, and perforated holes 502; deflectors 600; a heater core 710; and heater core retainers 800. The heater core 710 may be coupled with a control box (not shown).

Figure 3:
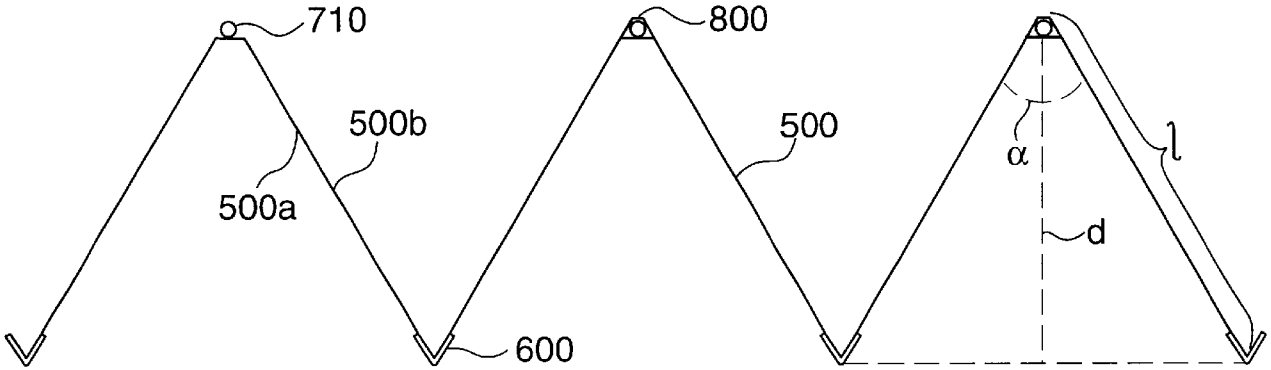
FIG. 3 is a diagram illustrating a plan view of the exemplary first embodiment of a snow extractor made in accordance with the present invention.

FIG. 3 is a plan view of the exemplary first embodiment 200. As shown, in the first embodiment the extractor plate 500 is shaped as connected "V"s. Outward facing edges of the first side 500*a* of the extractor plate 500 come to a point, while outward facing edges of the second side 500*b* are flattened to define a trough. As further shown, the heater core 710 is placed on the second side 500*b* of the extractor plate 500, adjacent to the flattened parts of the "VI"s. The runs of the heater core 710 are held in place by the heater core retainers 800.

The deflectors 600 are coupled to the pointed "V"s on the first side 500*a* of the extractor plate 500.

The connected "V" shape design of the snow extractor 200 provides numerous advantages. First, it creates a large surface area for snow (melting and) extraction to occur. It also results in a lower face velocity for the air passages, reducing the static pressure drop (e.g., a maximum of 300 feet per minute (fpm)). The lower pressure drop reduces the motor break horsepower required, lowering operating costs year round. Alternate snow removal methods can have 200–300% higher static pressure losses even when clean (e.g., velocities up to 700 fpm).

In addition, the thin design (e.g., 0.020 inches), and the perforated holes 502 (e.g., 0.156" in diameter) of the extractor plate 500 of the snow extractor 200 prevent and/or limit a filtering action, present in other snow extracting techniques. For example, some snow extracting techniques employ metallic mesh pads that are about two inches thick and act like filters, not allowing particles to pass through. As a result, particle build up and/or mold and bacterial growth may occur. The particle build up, which may include dust in the air and/or partially melted snow, slush and ice, also blocks normal airflow. The blocked airflow adds increased stress on the supply fan of an air handling system. In addition, mold and/or bacterial growth may lead to potential health risks. To prevent the adverse effects caused by the filtering effect, snow extractors that use metallic pads or meshes require continued maintenance to prevent blockage of airflow and/or mold and bacterial growth. The thin design and perforated holes 502 of the extractor plate 500 of the snow extractor 200 allow particles and contaminants to pass through. Consequently, the snow extractor 200 does not suffer from the problems caused by the filtering effect present in other snow extracting techniques.

Another advantage of the snow extractor 200 is the heater core 710 of the snow extractor 200 may have a "one piece" configuration. There are no pin connectors, splices or break points subject to corrosion in the path of the air stream. Metallic pads or woven mesh grids utilized in some other snow extractors may be provided in "modular" type panels. Each panel has an electrical connection to the next panel, in an air stream. These electrical connections offer points where corrosion may occur, and points where the electrical contact of the melting elements may break. Therefore, dependable operation may not always be provided when using "modular" type panels.

§4.2.3 Exemplary Second Snow Extractor Embodiment

Figure 4:
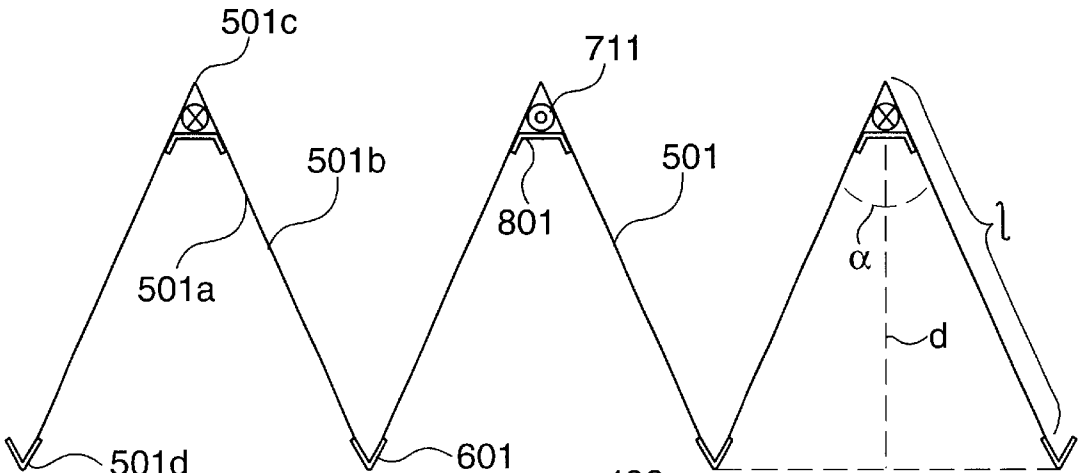
FIG. 4 is a diagram illustrating a plan view of an exemplary second embodiment of a snow extractor made in accordance with the present invention.

FIG. 4 illustrates a plan view of a second embodiment 400 of the present invention. Snow extractor 400 includes: an extractor plate 501 including a first side 501*a* and a second side 501*a*; deflectors 601; a heater core 711; and heater core retainers 801. The heater core 711 may be coupled with a control box (not shown). The extractor plate 501 defines a series of connected "V"s. The first side 501*a* forms an alternating pattern of edge points 501*d* and pockets 501*c*. The runs of the heater core 710 are located on the first side 501*a* of the extractor plate 501, inside the "V" shaped pockets 501*c*. The heater core retainers 801 are also placed inside the "V" shaped pockets 501*c* and hold the heater core 710 in place. The deflectors 601 are coupled to the first side 501*a* of the extractor plate 501"on the points 501*d*.

The second embodiment of the present invention shares a similar connected "V" shape, formed by a thin extractor plate 501 with perforated holes, as the first embodiment. Therefore, the second embodiment shares the above-mentioned benefits with the first embodiment.

§4.2.3 Exemplary Components of a Snow Extractor

The exemplary components of a snow extractor made in accordance with the present invention include an extractor plate, deflectors, a heating element, and heater core retainers. Exemplary embodiments of each component are described in further detail below.

Figure 5:
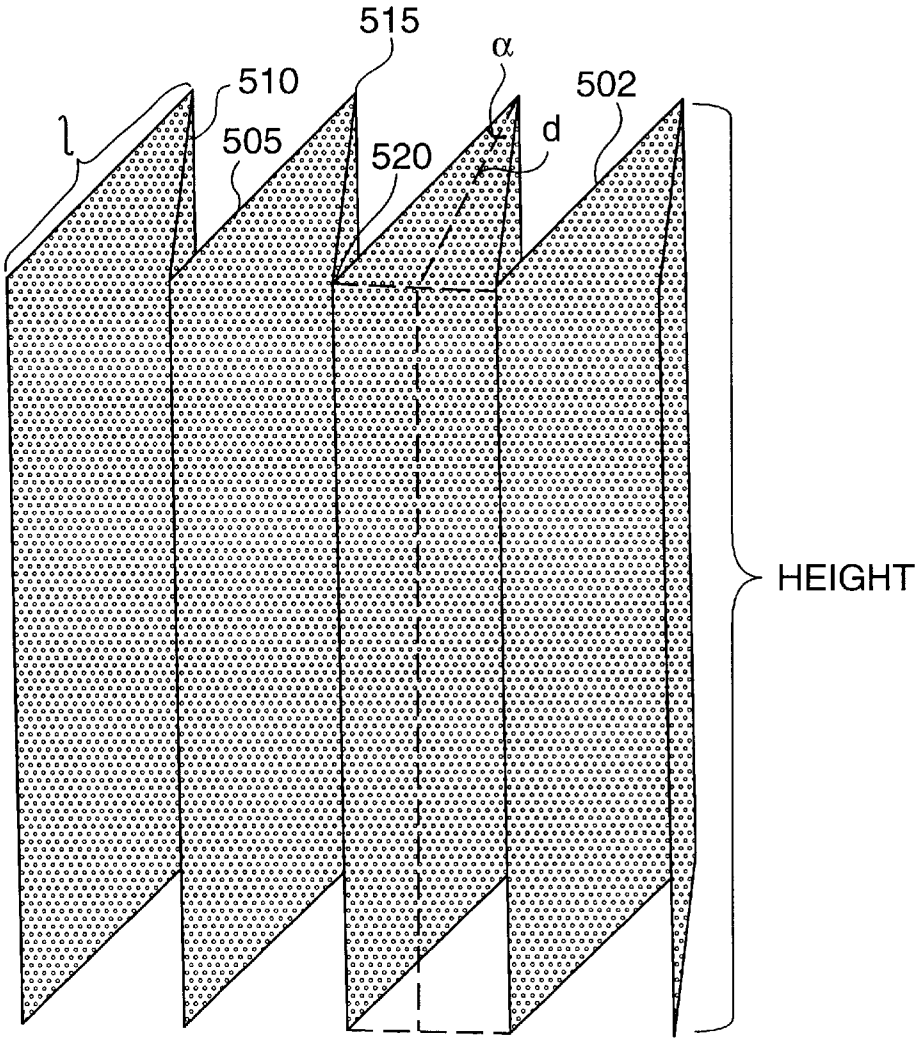
FIG. 5 is a diagram of an exemplary extractor plate that may be used in one embodiment of the present invention.

FIG. 5 illustrates an exemplary extractor plate 501' made in accordance with the present invention. The exemplary extractor plate 500' is preferably made of stainless steel (or any other suitable, preferably heat conducting, material such as aluminum for example) and has a preferred thickness range of approximately 0.020" to approximately 0.062", and preferably approximately 0.020 inches. The height of the exemplary extractor plate 501' preferably ranges from approximately 24 inches to approximately 48 inches, with a preferred height of approximately 48 inches. The exemplary extractor plate 501' is folded along a vertical axis to and is shaped as connected "VI"s. As shown in FIG. 5, each of the "V"s is folded to an angle represented by $\alpha$. The depth of the extractor plate 500, also shown in FIG. 5, is represented by d. The extractor plate has a first side 505 and a second side 510. Both of the sides 505, 510 include alternating points 520 and pockets 515, where the pocket of one side is the point of the other side. The length of one leg of the "V" shaped pocket, 1, as shown in FIG. 5, can preferably range from approximately four (4) inches to approximately eight (8) inches, with a preferred length of approximately six (6) inches. The depth of the "V" shaped pockets, d, can preferably range from approximately two (2) inches to approximately eight (8) inches. The angle of a "V" shaped pocket can preferably range from approximately 30° to approximately 45°, with a preferred angle of approximately 45°. Perforated holes 502 cover the extractor plate 501. The diameters of these perforated holes 502 can preferably range from approximately 0.125 inches to approximately 0.137 inches, and have a preferred diameter of approximately 0.156 inches.

As mentioned earlier the "V" shaped design of the extractor plate 501' provides advantages such as a large surface area for snow extraction and reduction of static pressure drop (e.g., a maximum of 300 fpm). The lower pressure drop reduces the motor break horsepower required, lowering operating costs year round.

In addition, the thin design (e.g., 0.020 inches), and the perforated holes 502 (e.g., 0.156" in diameter), prevent and/or limit the filtering action that occurs in other snow extracting techniques. The filtering action may lead to blocked airflows and/or mold and bacterial growth.

An exemplary extractor plate having troughs at edges on one side of the plate (Recall, e.g., 500 of FIG. 3.) may have a similar design.

Figure 6:
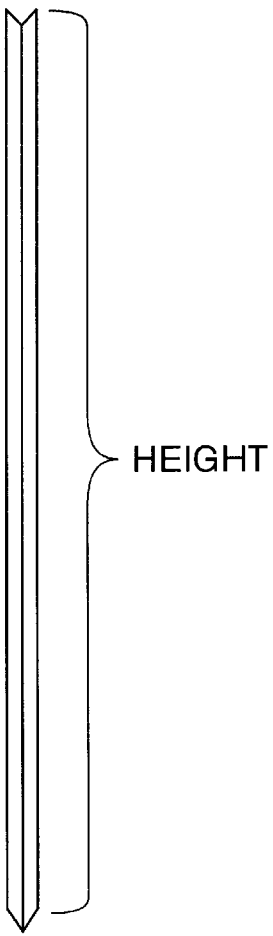
FIG. 6 is a diagram of an exemplary deflector that may be used in one embodiment of the present invention.

FIG. 6 illustrates a deflector 600 made in accordance with the present invention. The deflector 600 is preferably made of stainless steel (or any other suitable, preferable heat conducting, material such as aluminum) and has a preferred thickness range of approximately 0.020 inches to approximately 0.062 inches, and preferably approximately 0.020 inches. The height of the deflector 600 may range from approximately 24 inches to approximately 48 inches, with a preferred height of approximately 48 inches. This height preferably matches that of the extractor plate 500. The deflector 600' is also folded along a vertical axis to create a "V" shape. The preferred angle of the "V" shaped deflector is approximately 90 degrees, but may range from approximately 30 degrees to approximately 90 degrees. The length of one leg of the "VI" shaped deflector 600 can range from approximately 0.5 inches to approximately 0.75 inches, with a preferred length of approximately 0.5 inches.

The deflectors 600 may be attached to the extractor plate 500 using, e.g., wires and/or sheet metal screws. It is preferable that the deflectors 600 are removable from the extractor plate 500.

Figure 7:
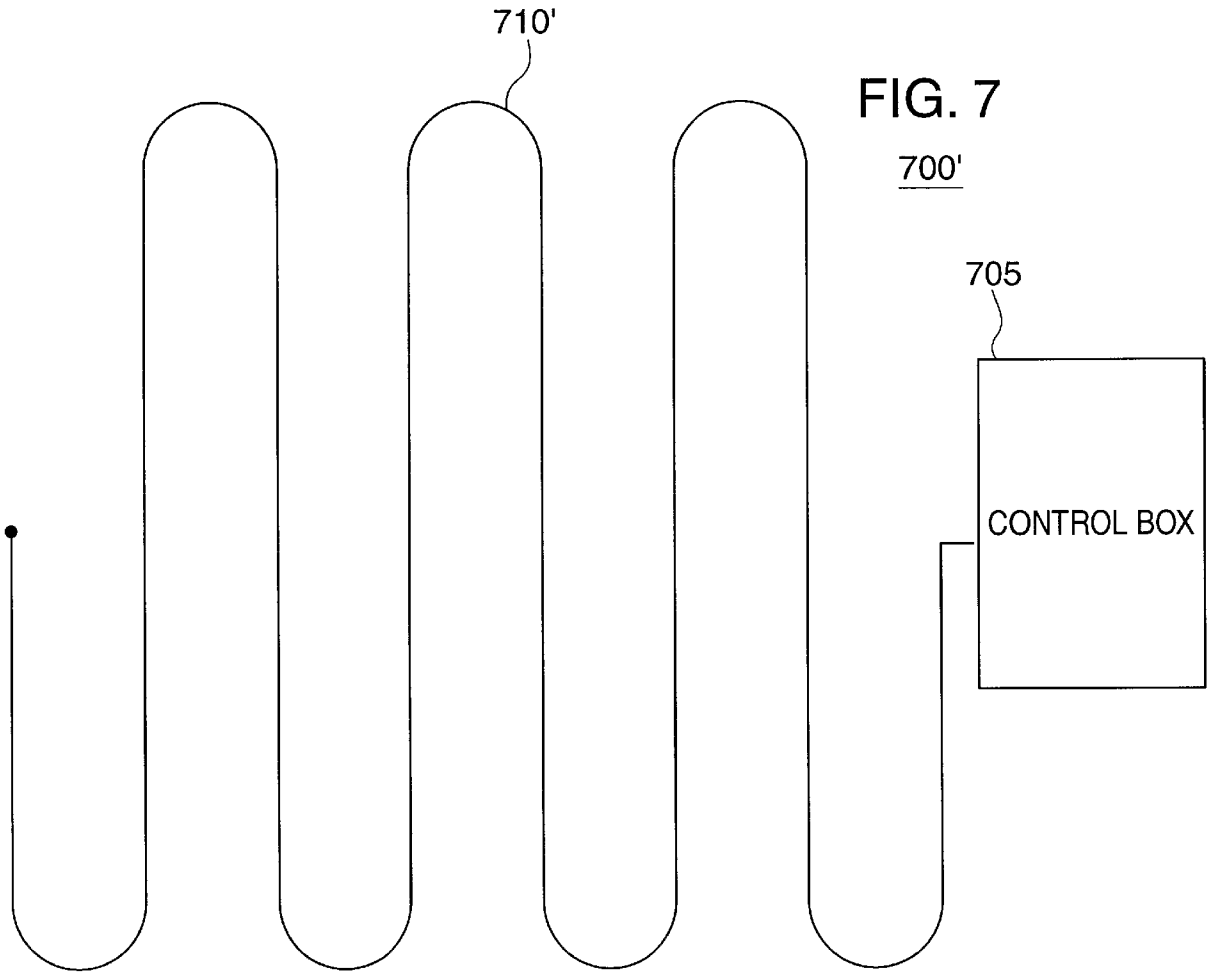
FIG. 7 is a diagram of an exemplary heating element that may be used in one embodiment of the present invention.

FIG. 7 illustrates an exemplary heating element 700'. The heating element 700 may be made using a heating cable system (e.g., a "delta-therm" Mineral Insulated (MI) cable). The exemplary heating element 700' includes a heater core 710', and a control box 705. The heater core 710' is preferably a one piece design that may comprise of at least one heating cable embedded in highly compressed magnesium oxide. The magnesium oxide layer may be further covered by copper or an alloy. This makes the heater coil 710 waterproof and resistive to corrosion. In one embodiment, the heater coil 700' has a maximum length of 200 feet and offers 60 watts per linear foot or 75 watts per square foot of extractor plate 500 surface.

Alternative means for heating the extractor plate 500 include electric infrared tubes (e.g., made by Spectrum), or radiant bulbs (e.g., oven lamps).

The heating coil 710' may be coupled with a control box 705. This control box 705 may be a snow sensing device. In this way, when the snow sensing device 705 detects snow mixed in the air stream, the heater core 710 is activated. Using a snow sensing device lowers operational costs by not requiring a person to manually activate the heater core 710. Some known snow sensing devices that may be used with the present invention include, the Delta-Therm SMC-90 snow sensing system and the Spectrum Infrared snow sensing system. All electrical wiring is preferably situated outside of the main air stream induced by the supply fan.

Figure 8:
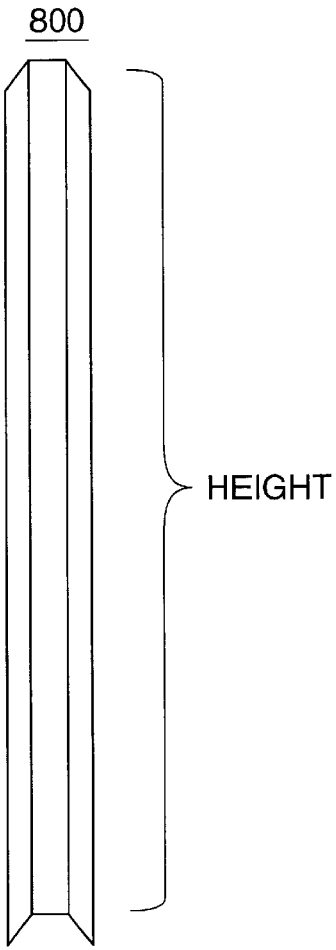
FIG. 8 is a diagram of an exemplary heater core retainer that may be used in one embodiment of the present invention.

FIG. 8 illustrates an exemplary heater core retainer 800' made in accordance with the present invention. The heater core retainer 800 is used to keep the heater core 710 coupled to the extractor plate 500. The heater core retainer 800 is preferably made of stainless steel (or aluminum) and has a preferred thickness of approximately 0.020 inches. The height of the heater core retainer 800 may range from approximately 24 inches to approximately 48 inches, with a preferred height of approximately 48 inches. This height preferably matches that of the extractor plate 500. The heater core retainer 800' includes two folds along a vertical axis to create a trough with a base and two sides. The two angles created by the vertical folds in the heater core retainer 800 correlate to the angle at which the extractor plate 500 is folded. The length of the base can range from approximately 0.375 inches to approximately 0.500 inches, with a preferred length of approximately 0.375 inches. The length of each of the sides of the heater core retainer 800' can range from approximately 0.250 inches to approximately 0.375 inches, with a preferred length of approximately 0.25 inches.

The heater core retainer 800 may be attached to the extractor plate 500 by, e.g., wires and/or sheet metal screws. It is preferable that the heater core retainers 800 are removable from the extractor plate 500.

§4.2.4. Exemplary Operations of a First Embodiment of a Snow Extractor

Installation and exemplary operations of the first embodiment of a snow extractor 200 made in accordance with the present invention will be described below, with reference to the air handling system 100 of FIG. 1 and the plan view of FIG. 3.

The snow extractor 200 is preferably positioned in air handling system 100 after the air intake dampeners 105 and before the filter 120. The first side 500*a* of the snow extractor 200 is preferably facing the air intake dampers 105, i.e., facing the incoming air stream, so that the heater core 710 is on the air outflow side of the snow extractor 200. The snow extractor 200 is to be installed with a vertical orientation to provide an unobstructed downward flow for snow melted on the extractor plate 500.

An exemplary operation of the first embodiment of the snow extractor 200, is described below. Air mixed with snow enters the air handling system 100, through the air intake dampers 105. The control box (not shown) coupled to the heater core 710 senses the snow and activates the heater core 710. The incoming air hits the deflectors 600, and the air mixed with snow is deflected towards the heater core 710', where the heat is most intense. The snow mixed in the air is melted as the air passes through the snow extractor 200, while most or all particles or contaminants can pass through perforated holes 502'.

The arrangement of the exemplary snow extractor 200 is based on the classic counter flow of thermal dynamics, having the extremes of warm and cold head towards each other. Other types of snow extractors are forced to use parallel air/heat flows. Parallel designs leave edges that are subject to freezing, thereby reducing airflow.

Alternatively, the snow extractor 200 may be installed with the second side 500*b* facing the air intake dampers 105, i.e., facing the incoming air stream; so that the heater core 710 is on the air intake side of the snow extractor 200. In this configuration the deflectors 600 are not necessary.

§4.2.5 Exemplary Operations of a Second Embodiment of a Snow Extractor

Installation and exemplary operations of the second embodiment of a snow extractor 400 made in accordance with the present invention will be described below, with reference to the air handling system 100 of FIG. 1 and the plan view of FIG. 4.

The snow extractor 400 is preferably positioned in air handling system 100 after the air intake dampeners 105 and before the filter 120. The second side 501*b* of the snow extractor 400 is preferably facing the air intake dampers 105, i.e., facing the incoming air stream, so that the heater core 711 is on the air outflow side of the extractor plate 501. The snow extractor 400 is to be installed with a vertical orientation to provide an unobstructed downward flow for snow melted on the extractor plate 501.

An exemplary operation of the first embodiment of the snow extractor 400, is described below. Air mixed with snow enters the air handling system 100, through the air intake dampers 105. The control box (not shown) coupled to the heater core 711 senses the snow and activates the heater core 711. The incoming air first hits the points of the second side 501*b*, where the heat is most intense, and the snow is melted out of the air stream. In such an installation, the air deflectors 601 aren't necessary. Most or all particles or contaminants in the air can pass through the perforated holes on the snow extractor 400.

Alternatively, the snow extractor 400 may be installed with the first side 501*a* facing the air intake dampers 105, i.e., facing the incoming air stream, so that the heater core 711 is on the air intake side of the extractor plate 501. In this configuration the deflectors 601 are placed on the edge points of the first side 501*a* of the snow extractor 400 to deflect the air towards the runs of the heater core 711'.

§4.3 Conclusions

As mentioned above, there are numerous benefits of the present invention over products known in the art. Compared to other snow extractors the initial costs are low, operating costs are low, maintenance costs are low and risks associated with potential health problems involving mold or bacterial growth are low.

The snow extractor of the present invention provides for low initial costs and is easy to install.

The open "V"-pocket design results in a lower face velocity for air passages, reducing the static pressure drop. For example, the deep pocket design of at least some of the preferred embodiments provides a large face area, keeping the pass through velocity at or under 300 FPM, which is less than half the face velocity of prior snow removal products. This low face velocity increases snow melting efficiency. The lower pressure drop reduces the motor brake horsepower required, lowering operating costs year round. Further, the vertical paths defined by each of the pockets facilitate the run off of the melted snow.

A filtering effect occurs in snow extractors that use metallic pads or meshes, because those metallic pads used to stop the snow also stops particles and contaminants. The holes in the snow extractor of the present invention allow particles and contaminants to pass through, and the filtering effect does not occur. Thus, the snow extractor of the present invention can be left in place year round. The removal/installation of other snow extractors and/or pre-filters lead to higher maintenance costs.

In addition, the filtering effect found in other snow extractors may lead to fungal or bacterial growth if not properly cleaned. This may turn into a potential health risk if the mold and/or bacteria enter the ventilation system of a building. Consequently, some other snow extractors require continual cleaning, which increases maintenance costs. The holes in the extractor plate and the thin design of the present invention prevent and/or limit the filtering effect from occurring. Moreover, the vertical deep pocket design define paths that facilitate the constant drainage of water, preventing the melted snow from refreezing and stagnant pools water. Therefore using the snow extractor of the present invention limits and/or eliminates added maintenance costs associated with some other snow extracting techniques. For example, the inventor believes maintenance may be limited to a simple periodic (e.g., every six months) wiping of the deep vertical pockets.

The snow extractors of the present invention may be provided in factory built air handling systems, or field built HVAC systems, and may be retrofitted into such systems.

What is claimed is:

1. An apparatus for extracting snow from the air entering an air handling or HVAC system, the apparatus comprising:

a plate being bent along a plurality of vertical axes, to define a series of connected "V"s having an alternating series of edge points and pockets, the pockets being flattened to form a trough, having perforated holes and having a first side and a second side; and means for heating said plate.

2. The apparatus of claim 1 wherein the means for heating said plate is a heater core including vertical runs provided adjacent to the flattened pockets on the second side of said plate.

3. The apparatus of claim 1 wherein the plate has a thickness of approximately 0.020 inches.

4. The apparatus of claim 1 wherein a length of one leg of the connected "V"s, l, of said plate is in a range extending from and including approximately four inches to and including approximately eight inches.

5. The apparatus of claim 1 wherein a length of one leg of the connected "V"s, l, of said plate is approximately six inches.

6. The apparatus of claim 1 wherein an angle of the pockets, $\alpha$, of said plate is in a range extending from and including approximately 30 degrees to and including approximately 90 degrees.

7. The apparatus of claim 1 wherein an angle of the pockets, $\alpha$, of said plate has an angle of approximately 45 degrees.

8. The apparatus of claim 1 wherein a depth, d, of said plate is in a range extending from and including approximately four inches to and including approximately eight inches.

9. The apparatus of claim 1 wherein a depth, d, of said plate is approximately six inches.

10. The apparatus of claim 2, further comprising:

heater core retainers being placed over the vertical runs of the heating coil to hold the heater core to the plate.

11. The heater core retainers of claim 10, being bent along two vertical axes, defining a trough having a base and two sides.

12. The apparatus of claim 1, wherein the apparatus is part of an air handling system with the second side facing an air intake side of the air handling system.

13. The apparatus of claim 1, wherein the apparatus is part of an air handling system with the first side facing an air intake side of the air handling system.

14. The apparatus of claim 13 further comprising:

deflectors being bent along a vertical axis located in the middle of the deflector, the deflectors being placed on the points of the first side of the plate.

15. The apparatus of claim 14 wherein the deflectors are bent at an angle in the range extending from and including approximately 45 degrees to and including approximately 90 degrees.

16. The apparatus of claim 14 wherein the deflectors are bent at an angle of approximately 90 degrees.

17. The apparatus of claim 14 wherein the deflectors deflect entering air towards a hottest part of the plate.

18. The apparatus of claim 1, wherein the means for 2 heating said plate includes:

a heater core; and a control element for sensing snow mixed with air entering an air handling system, the control element adapted to activate said heater core when snow is detected, and to deactivate said heater core when snow is no longer detected.

19. The apparatus of claim 1 wherein the plate and the means for heating said plate are provided to produce a counter flow reaction in which extremes of warm and cold head towards each other.

20. The apparatus of claim 1 wherein the plate is provided to limit a static pressure drop in the air handling system is no more than approximately 300 feet per minute.

21. An apparatus for extracting snow from the air entering an air handling or HVAC system, the apparatus comprising:

a plate being bent along a plurality of vertical axes, to define a series of connected V's having an alternating series of edge points and pockets, having perforated holes and having a first side and a second side; and means for heating said plate.

22. The apparatus of claim 21 wherein the means for heating said plate is a heater core including vertical runs provided adjacent to the pockets on the first side of said plate.

23. The apparatus of claim 21 wherein the plate has a thickness of approximately 0.020 inches.

24. The apparatus of claim 21 wherein a length of one leg of the connected "V"s, l, of said plate is in a range extending from and including approximately four inches to and including approximately eight inches.

25. The apparatus of claim 21 wherein a length of one leg of the connected "V"s, l, of said plate has a length of approximately six inches.

26. The apparatus of claim 21 wherein an angle of the pockets, $\alpha$, of said plate is in a range extending from and including approximately 30 degrees to and including approximately 90 degrees.

27. The apparatus of claim 21 wherein an angle of the pockets, $\alpha$, of said plate has an angle of approximately 45 degrees.

28. The apparatus of claim 21 wherein a depth, d, of said plate is in a range extending from and including approximately 2 inches to and including approximately 12 inches.

29. The apparatus of claim 22, further comprising:

heater core retainers being placed over the vertical runs of the heater core to hold the heater core to the plate.

30. The heater core retainers of claim 29, being bent along two vertical axes, defining a trough having a base and two sides.

31. The apparatus of claim 21, wherein the apparatus is part of an air handling system with the second side facing an air intake side of the air handling system.

32. The apparatus of claim 21, wherein the apparatus is part of an air handling system with the first side facing an air intake side of the air handling system.

33. The apparatus of claim 32 further comprising:

deflectors being bent along a vertical axis located in the middle of the deflector, the deflectors being placed on the points of the first side of the plate.

34. The apparatus of claim 33 wherein the deflectors have a preferred thickness of 0.020 inches.

35. The apparatus of claim 33 wherein the deflectors are bent at an angle in a range extending from and including approximately 45 degrees to and including approximately 90 degrees.

36. The apparatus of claim 33 wherein the deflectors are bent at an angle of 90 degrees.

37. The apparatus of claim 33 wherein the deflectors deflect entering air towards a hottest part of the plate.

38. The apparatus of claim 21, wherein the means for heating said plate includes:

a heater core; and a control element for sensing snow mixed with air entering an air handling system, the control element adapted to activate said heater core when snow is detected, and to deactivate said heater core when snow is no longer detected.

39. The apparatus of claim 21 wherein the plate and the means for heating said plate are provided to produce a counter flow reaction in which extremes of warm and cold head towards each other.

40. The apparatus of claim 21 wherein the plate is provided to limit a static pressure drop in the air handling system to no more than approximately 300 feet per minute.

* * * * *